US007121045B2

(12) United States Patent
Massey et al.

(10) Patent No.: US 7,121,045 B2
(45) Date of Patent: Oct. 17, 2006

(54) PRE-HANGING CLIP FOR PRE-HUNG DOOR

(75) Inventors: Victor Massey, Orting, WA (US); Joy Doiley, Charlotte, NC (US)

(73) Assignee: Premdor International, Inc., Bridgetown (BB)

( * ) Notice: Subject to any disclaimer, the term of this patent is extended or adjusted under 35 U.S.C. 154(b) by 31 days.

(21) Appl. No.: 10/915,728

(22) Filed: Aug. 11, 2004

(65) Prior Publication Data

US 2005/0102906 A1 May 19, 2005

Related U.S. Application Data

(60) Provisional application No. 60/495,877, filed on Aug. 19, 2003.

(51) Int. Cl.
*E06B 3/32* (2006.01)

(52) U.S. Cl. ..... 49/380; 206/325

(58) Field of Classification Search ..... 49/380, 49/503, 504; 206/325; 24/702, 669; 16/257, 16/267; 248/316.7, 346.04, 231.81, 227.4
See application file for complete search history.

(56) References Cited

U.S. PATENT DOCUMENTS 3,301,820 A * 1/1967 Haendiges ..... 206/325
4,483,101 A * 11/1984 Berzina ..... 49/380
4,718,195 A * 1/1988 Ortega ..... 49/380
5,365,697 A * 11/1994 Vanderpan ..... 49/380
5,562,315 A * 10/1996 Sales ..... 292/150
5,722,203 A * 3/1998 Staples et al. ..... 49/380
5,787,639 A * 8/1998 Lamore, Jr. ..... 49/380
6,152,642 A * 11/2000 Berthold et al. ..... 403/155
6,170,198 B1 * 1/2001 Staples et al. ..... 49/380
6,357,181 B1 * 3/2002 Triemstra ..... 49/380
2004/0060241 A1 * 4/2004 Staples et al. ..... 49/380

* cited by examiner

*Primary Examiner*—Gregory J. Strimbu
(74) *Attorney, Agent, or Firm*—Berenato, White & Stavish, LLC

(57) ABSTRACT

A pre-hung door having a door jamb and a door connected to the door jamb. The door has an opening formed therein for receiving door hardware. A pre-hanging door clip is operatively connected to the door and the door jamb to limit relative movement between the door and the door jamb. The pre-hanging door clip includes a movement limiting structure that extends through the opening in the door and that has one end thereof engaged with the door jamb. The pre-hanging door clip also includes a locking member that extends between the door and the door jamb to cooperatively interlock with the one end of the movement limiting structure such that relative movement between the door and the door jamb is limited.

9 Claims, 5 Drawing Sheets

PRE-HANGING CLIP FOR PRE-HUNG DOOR

CROSS REFERENCE TO RELATED APPLICATION AND CLAIM TO PRIORITY

This application is a non-provisional application based upon the provisional application Ser. No. 60/495,877, filed Aug. 19, 2003, the disclosure of which is incorporated herein by reference and priority to which is claimed pursuant to 35 U.S.C. § 120.

BACKGROUND OF THE INVENTION

1. Field of the Invention

The invention relates to pre-hung door assemblies including a door jamb and a door attached to the door jamb. More particularly, the invention relates to a pre-hanging clip for such pre-hung doors for use when transporting the same.

2. Description of Related Art

It is common practice to manufacture doors that are pre-hung in a frame. This simplifies the installation and reduces the cost. Pre-hung doors are conventionally utilized in most new and remodeling building constructions and include a squared frame in which a door is pre-hung (hinged). The door is properly shim spaced relative to opposing frame portions. The door and door jambs are prepped for the installation of lock sets (door hardware), but are not fitted with the knobs, striker plates, latches and such since there are unlimited models and configurations from which a user may choose. The doors are attached to the hinge jamb by hinges and the assembly requires a fastener to hold the door in a "closed" position relative to the door jambs during transport or shipment. If the door is not secured to the door jambs in a closed position, the door jamb is readily damaged. The door is preferably secured tightly to the strike jamb so that no relative movement will occur during shipment. Any movement can cause a rubbing action between the door and strike jamb which will likely cause damage to the surface of the door and jamb or at least leave unsightly marks.

Current practice is to drive nails through the strike jamb into the edge of the door to securely hold the door during shipping from point of manufacture to point of installation. The nails utilized are typically double headed to facilitate removal. The door is secured to the frame to prevent damage during shipment and handling. To prevent movement of the door during shipping and prior to installation, the door is nailed at the top and along both sides to the corresponding frame members. When installing such a pre-hung door, the nails must be pulled and the nail holes in the door must be filled before the door can be painted or otherwise finished.

The use of nails is undesirable. The nails, which will later be removed, leave holes in the edge of the door and face of the strike jamb, which must be filled, sanded and finished. Additionally, the nails driven in through the strike jamb may on occasion cause splitting of the door jamb or edge of the door. The double headed nails protrude from the surface of the backside of the door jambs and may cause damage to adjacent doors or casings during shipment. Avoiding the use of such fasteners is therefore an object of the present invention. A need exists for an improved means by which the door of a pre-hung door assembly may be secured in the closed position from the time it is completed as an assembled unit by the manufacturer until the time it is to be installed.

Currently, door retainers such as the door retainer of U.S. Pat. No. 5,159,782, are utilized to secure the pre-hung door and the frame in position relative to each other. The door retainer is formed from a plastic material and is configured to fit into the edge bore of the door and is movable to extend into the bore in the strike side of the frame provided for the latch mechanism. The retainer is internally threaded to receive a threaded locking member. The retainer is configured so that it may be inserted into the edge bore of the door through the door's face bore. The retainer is of sufficient length to extend into the bore of the strike jamb. Extending lobes on the retainer engage the arc surface of the face bore of the door to limit the entry of the retainer in the edge bore. The threaded locking member is then inserted through the backside of the bore in the strike jamb and is threadably installed in the threaded end of the retainer to effectively secure the door and frame one to the other.

SUMMARY OF THE INVENTION

One aspect of the invention is to provide a pre-hung door assembly including a pre-hanging door clip. The pre-hung door assembly has a door jamb and a door connected to the door jamb. The door has an opening formed therein for receiving door hardware. A pre-hanging door clip is operatively connected to the door and the door jamb to limit relative movement between the door and the door jamb to prevent damage to the door during transportation. The pre-hanging door clip includes a movement limiting structure that extends through the opening in the door and that has one end thereof engaged with the door jamb. The pre-hanging door clip also includes a locking member that extends between the door and the door jamb to cooperatively interlock with at least one end of the movement limiting structure to limit the relative movement between the door and the door jamb.

Another aspect of the invention is to provide a pre-hanging door clip. The pre-hanging door clip comprises a movement limiting structure and a locking member configured to engage the movement limiting structure to limit relative movement between a door and a door jamb to which the door is attached. The movement limiting structure is configured to extend through an opening in the door and has one end thereof engaged with the door jamb. The locking member extends between the door and the door jamb to cooperatively interlock with the one end of the movement limiting structure to limit the relative movement between the door and the door jamb.

BRIEF DESCRIPTION OF THE DRAWINGS

The invention will be described in conjunction with the following drawings in which like reference numerals designate like elements and wherein.

DETAILED DESCRIPTION OF EMBODIMENTS

Figure 1:
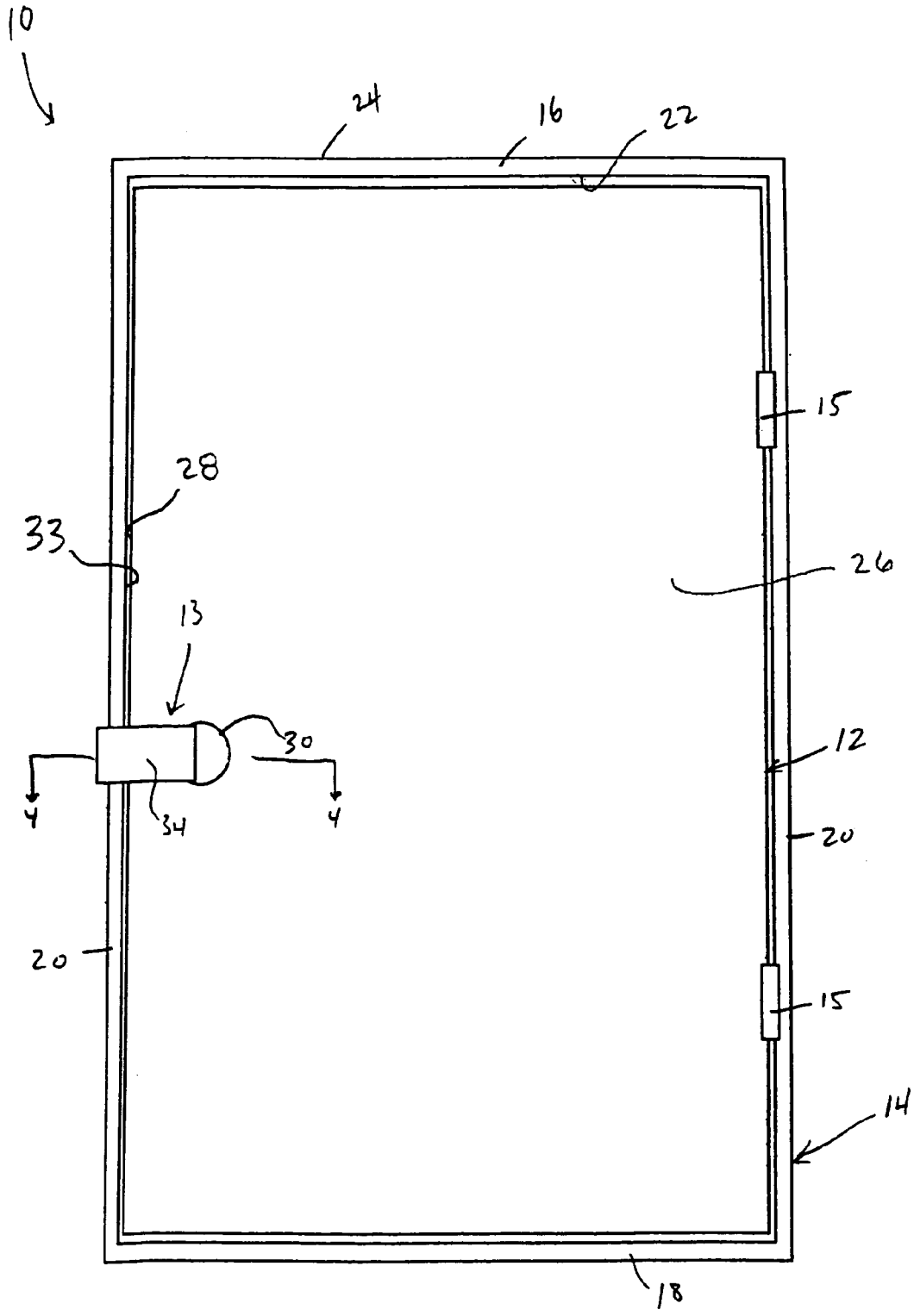
FIG. 1 is a front view of a door assembly in accordance with the principles of the present invention having a pre-hanging door clip mounted thereon.

FIG. 1 shows a door assembly 10 having a door 12 and a door jamb or a door frame 14 substantially surrounding the door 12. A pre-hanging door clip, generally shown at 13, can be provided to limit relative movement between the door 12 and the door frame 14 during shipping or transport, for example. The clip 13 is removed prior to installation of the door frame. The door assembly 10 can be positioned within a doorway (not shown) in different areas of a residential or commercial structure, such as, in an interior doorway, a patio door opening, a doorway between rooms, or a closet doorway, for example. Although only a single door is shown, the door assembly 10 can include double doors or a door with a sidelite, for example. In such an installation, the clip 13 will be received on a portion of the mullion positioned between the adjacent doors or the door and the sidelite.

Figure 2:
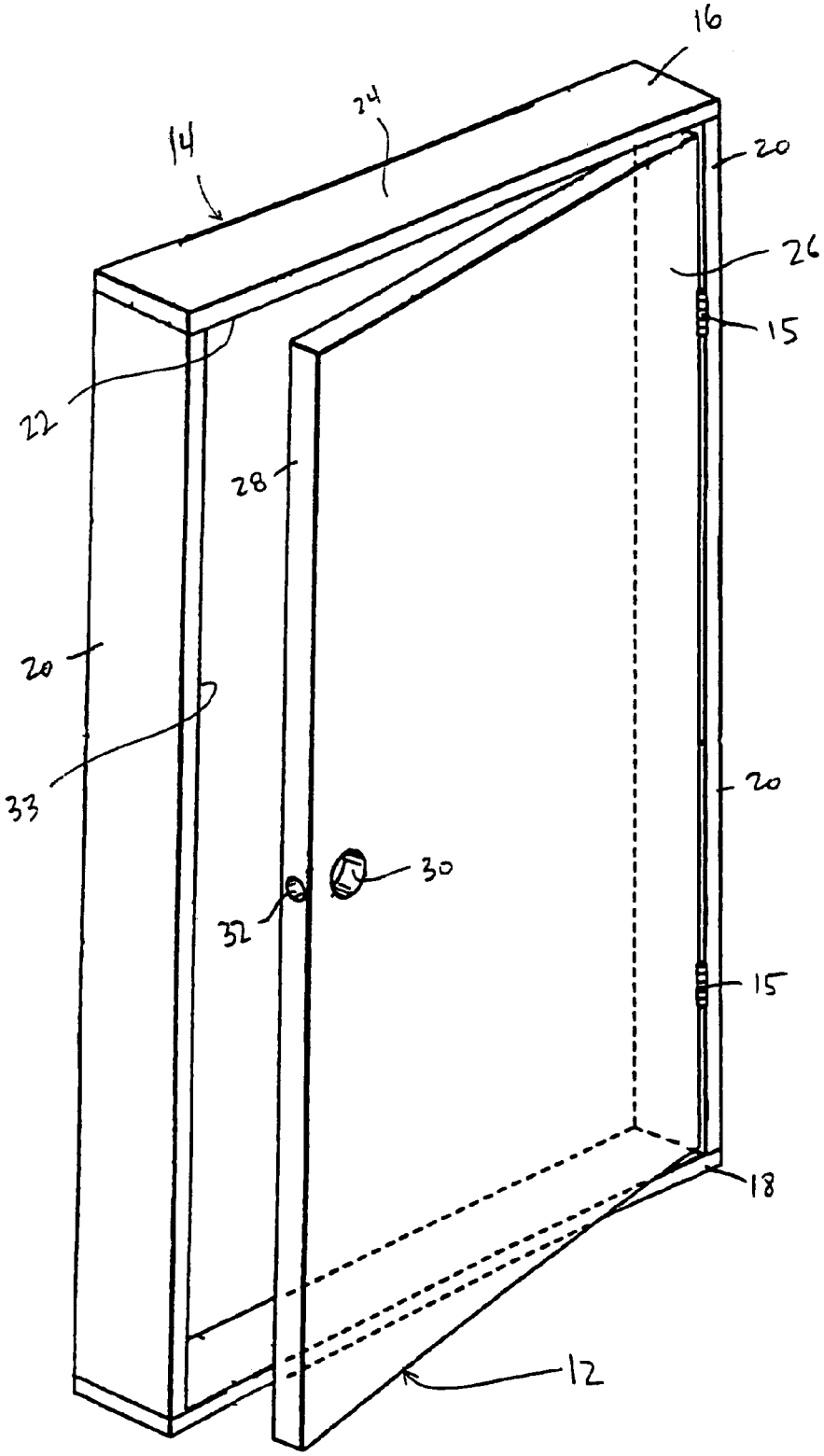
FIG. 2 is a perspective view of a door and a door jamb of the door assembly shown in FIG. 1.

As described above, it is common practice to manufacture doors that are pre-hung in a frame, such as the conventional door frame 14 shown in FIG. 2. This simplifies the installation and reduces the cost. In this manner, the door 12 can be secured to the frame 14 by hinges 15 to prevent damage during shipment, transportation and handling.

The door frame 14, having a generally rectangular configuration, includes a top jamb 16, a bottom jamb 18 and a pair of side jambs 20. The top jamb 16 is connected to each of the side jambs 20 and the bottom jamb 18 is connected to each of the side jambs 20 to form the generally rectangular configuration. A jamb is described below as being any of the top jamb 16, the bottom jamb 18, the side jambs 20 or any other part of a door or door molding that can be positioned adjacent a doorway including a mullion. Furthermore, a jamb may include elongated jambs that may be used for moldings, for example. These jambs can be formed of various materials and formed into various shapes and is not limited to a flat, rectangular object. For example, each of the top jamb 16, the bottom jamb 18 and the side jambs 20 can be made from wood, wood polymer composite, fiberglass, metal or any other suitable material that can be used to make an entire door or any part of a door.

Any combination of the top jamb 16, the bottom jamb 18 and the side jambs 20, can be connected to form different frame configurations. Alternatively, the jambs can be arched, for example, to form an arch-topped door or other door or frame configuration. Each of the top jamb 16, the bottom jamb 18 and the side jambs 20 includes a peripheral inner surface 22. The peripheral inner surface 22 of the top jamb 16, the bottom jamb 18 or the side jambs 20 can include door stop structure (not shown) mounted thereto as is conventionally known. Each of the top jamb 16, the bottom jamb 18 and the side jambs 20 also includes a peripheral outer surface 24 that is opposite and substantially parallel to the peripheral inner surface 22. The peripheral outer surface 24 is substantially flat and is configured to be placed adjacent the doorway.

FIG. 2 shows the door 12 in greater detail. The door 12 has front and rear surfaces (only front surface 26 is shown) and a strike edge 28. The strike edge 28 of the door 12 aligns with an interior strike surface 33 of the door frame 14 when the door 12 is moved into a closed position within the door frame 14 (FIG. 1). The side jambs 20 can be referred to as strike jambs and the interior strike surface 33 is the portion of strike jamb 20 adjacent to the strike edge 28 of the door when the door 12 is moved into a closed position within the door frame 14 (FIG. 1). The door 12 also has a hardware opening 30 (sometimes referred to as a face bore) that extends between front and rear surfaces thereof for mounting door hardware, such as a knobs, striker plates, latches, door handles and such, to the door 12. In the illustrated embodiment, the hardware opening 30 is of annular configuration, but other shapes or configurations could be used as well. The strike jamb 20 can include a recess 31 (FIG. 4) formed on an interior strike surface 33 thereof. The recess 31 is configured to receive door hardware when installed in the door 12. An axial bore 32 is formed in the door 12 to extend from the door edge 28 to the hardware opening 30 and is configured to receive door hardware.

Figure 3:
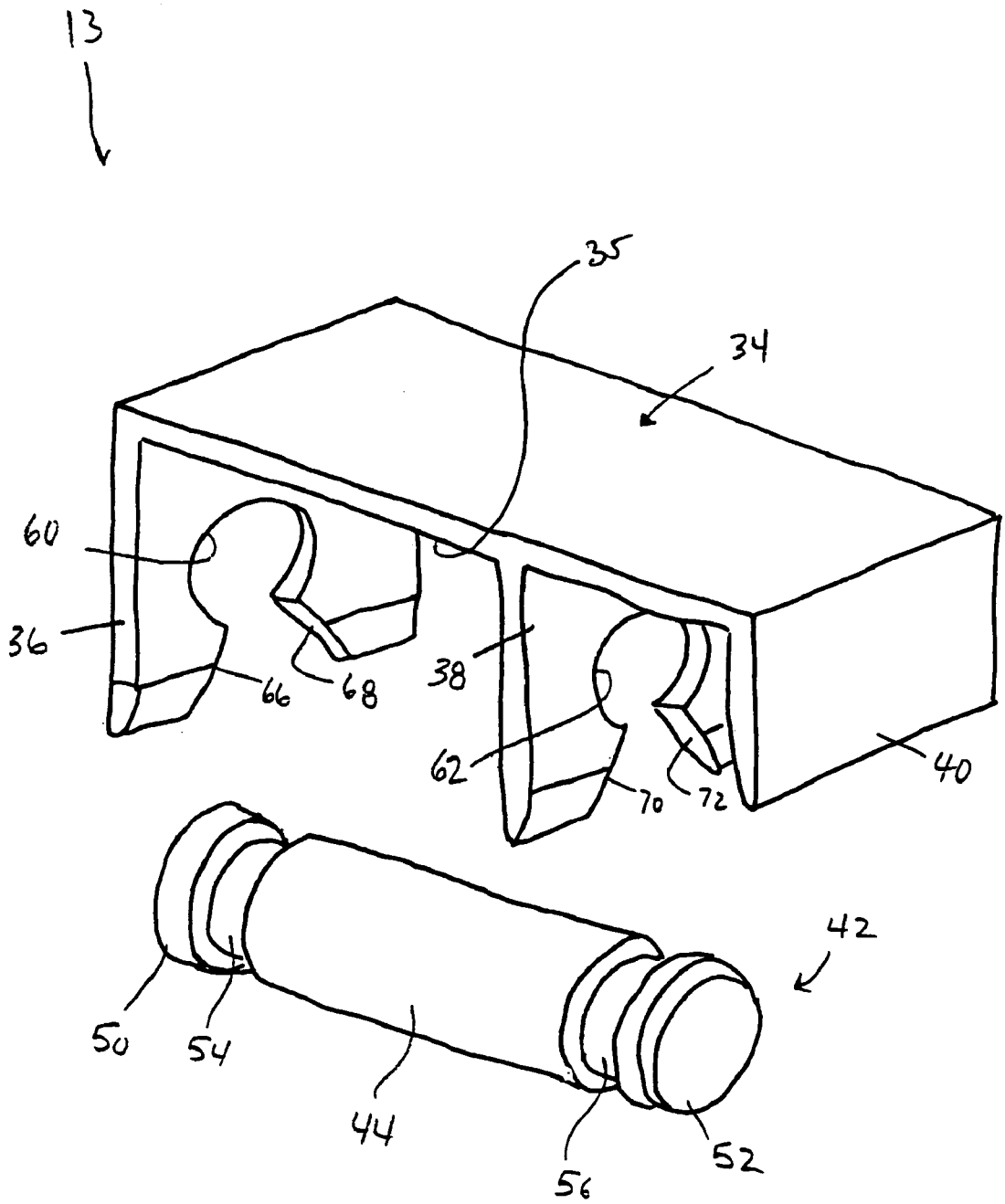
FIG. 3 is an exploded view of a pre-hanging clip of the door assembly shown in FIG. 1.
Figure 4:
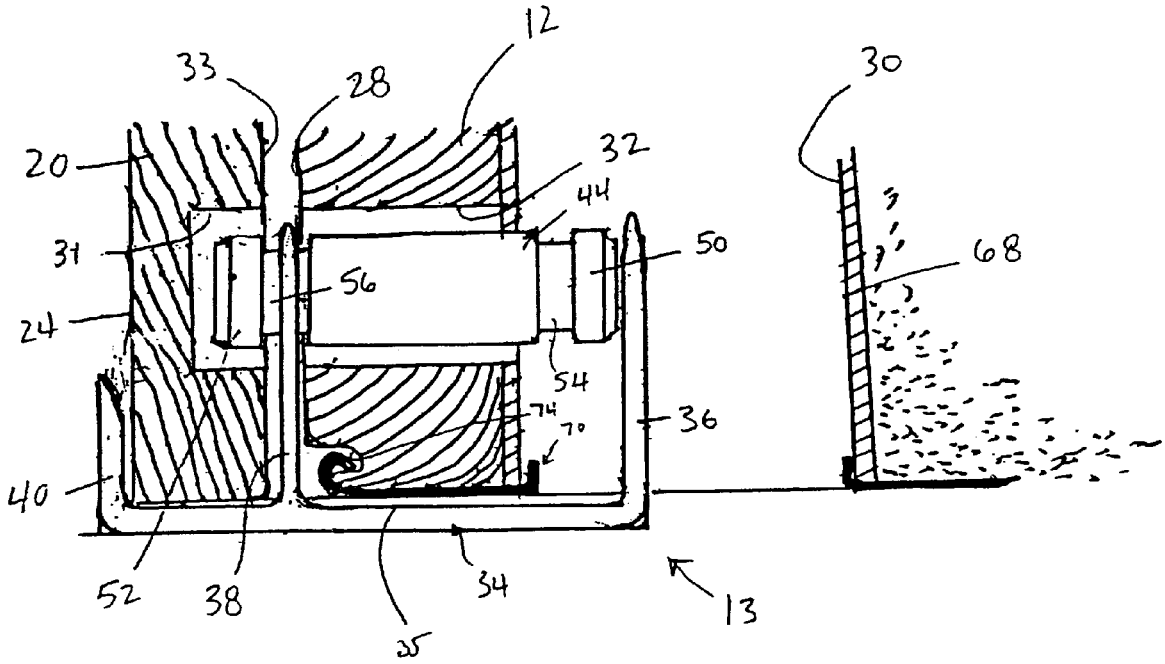
FIG. 4 is a cross sectional view through line 4—4 of FIG. 1 showing the pre-hanging clip mounted to the door assembly and the door jamb.

As best seen in FIGS. 3 and 4, the pre-hanging door clip 13 includes a movement limiting structure 42 of generally cylindrical construction that is received by an intermediate wall portion or locking member 38 to cooperatively secure the movement limiting structure 42 to the intermediate wall portion 38.

The movement limiting structure 42 includes a generally cylindrical body, as shown in FIG. 3. The structure 42 includes end portions 50, 52 and a mid-portion 44. A pair of reduced diameter portions 54, 56 are posited between the end portions 50, 52 and the mid-portion 44. The limiting structure 42 can be formed as a single molded or cast piece. The structure 42 can also be assembled from multiple components. With such an arrangement, the reduced diameter portions 54, 56 can be formed from an elongated shaft that extends substantially the length of the structure 42. The end portions 50, 52 are fixedly secured to the shaft. The mid-portion 44 can either be fixedly or slidably secured to the shaft. The shaft can move relative to the mid-portion 44 to change the width of the reduced diameter portions 54, 56.

The pre-hanging door clip 13 also includes a generally flat clip 34 having a bottom surface 35 that extends in an axial direction. The bottom surface 35 can abut the front surface 26 of the door 12 when the pre-hanging door clip 13 is mounted to the door 12 and the door frame 14. On doors having molding, for example, the bottom surface 35 can abut the molding of the door 12 when the pre-hanging door clip 13 is mounted to the door 12 and the door frame 14.

The clip 34 has a first end wall portion 36, an intermediate wall portion 38 and a second end wall portion 40 each transversely extending from the bottom surface 35 of the clip 34. The first end wall portion 36 is configured to extend into the hardware opening 30 when the pre-hanging door clip 13 is mounted to the door 12 and the door frame 14, as shown in FIG. 4. The intermediate wall portion 38 is configured to extend between the strike edge 28 of the door 12 and the strike jamb 20 of the door frame 14 when the pre-hanging door clip 13 is mounted to the door 12 and the door frame 14. The second end wall portion 40 is configured to abut the peripheral outer surface 24 of the strike jamb 20 when the pre-hanging door clip 13 is mounted to the door 12 and the door frame 14.

The second end wall portion 40 can extend a shorter distance than the first end wall portion 36 and the intermediate wall portion 38. The first end wall portion 36 and the intermediate wall portion 38 are configured to engage the movement limiting structure 42, and for this reason, the first end wall portion 36 and the intermediate wall portion 38 generally extend a greater distance than the second end wall portion 40.

The first end wall portion 36 and the intermediate wall portion 38 have a respective recess 60, 62 formed therein and each include outwardly diverging surfaces 66, 68 and 70, 72 respectively. Each recess 60, 62 can be shaped to correspond to the shape of the reduced diameter portions 54, 56 of the movement limiting structure 42. The outwardly diverging surfaces 66, 68 and 70, 72 allow positioning of one portion 54, 56 of the movement limiting structure 42 near the respective recess 60, 62. However, manual force is required to move the portions 54, 56 into the respective recess 60, 62 so that at least one of the portions 54, 56 can be retained in the recesses 60, 62. In this manner, the movement limiting structure 42 can be fixedly secured to the clip 34. A snap fit connection is created between the clip 34 and the movement limiting structure 42.

As shown in FIGS. 3 and 4 and described above, the first end wall portion 36 and the intermediate wall portion 38 of the clip 34 can be formed of identical configuration to receive one reduced diameter portion 54, 56 of the movement limiting structure 42. However, the clip 13 need only have the intermediate wall portion 38 configured to receive one reduced diameter portion 54, 56 of the movement limiting structure 42 to limit relative movement between the door 12 and the door frame 14. The first end wall portion 36 can then be formed of identical configuration as the second end wall portion 40.

It is contemplated that some movement between the door 12 and the door frame 14 may occur during shipping or transport, but the clip 13 limits relative movement between the door 12 and the door frame 14 so that no damage occurs to the door 12 or door frame 14.

To install the pre-hanging clip 13 in the door assembly 10, the door 12 is moved into a closed position within the door frame 14 (FIG. 1 and 4). End portion 52 of the clip 34 is positioned to be received in the recess 31 of the strike jamb 20 and the mid-portion 44 and the other end portion 54 of the clip 34 are positioned to extend through the axial bore 32 of the door and into the hardware opening 30. The first end wall portion 36 is positioned to extend through the hardware opening 30, the intermediate wall portion 38 is positioned to abut the strike edge 28 of the door 12 and the strike jamb 20 of the door frame 14 and the second end wall portion 40 is positioned to abut the peripheral outer surface 24 of the strike jamb 20. Upon the application of manual force, one reduced diameter portion 56 is moved into the recess 62 so that the portion 56 can be retained therein. In this manner, the movement limiting structure 42 is secured to the clip 34. While it is shown that only of the reduced diameter portions 54, 56 engages a respective recess 60, 62, the length of the structure 52 can be such that reduced diameter portion 54 is received within recess 60 while the reduced diameter portion 56 is simultaneously received within the recess 62.

FIG. 4 shows that the door 12 can have a reinforcing member 68, of metal, plastic or some other rigid material, substantially surrounding the interior of the hardware opening 30. The outer surfaces of the door can be formed from a molded panel 70.

Figure 5:
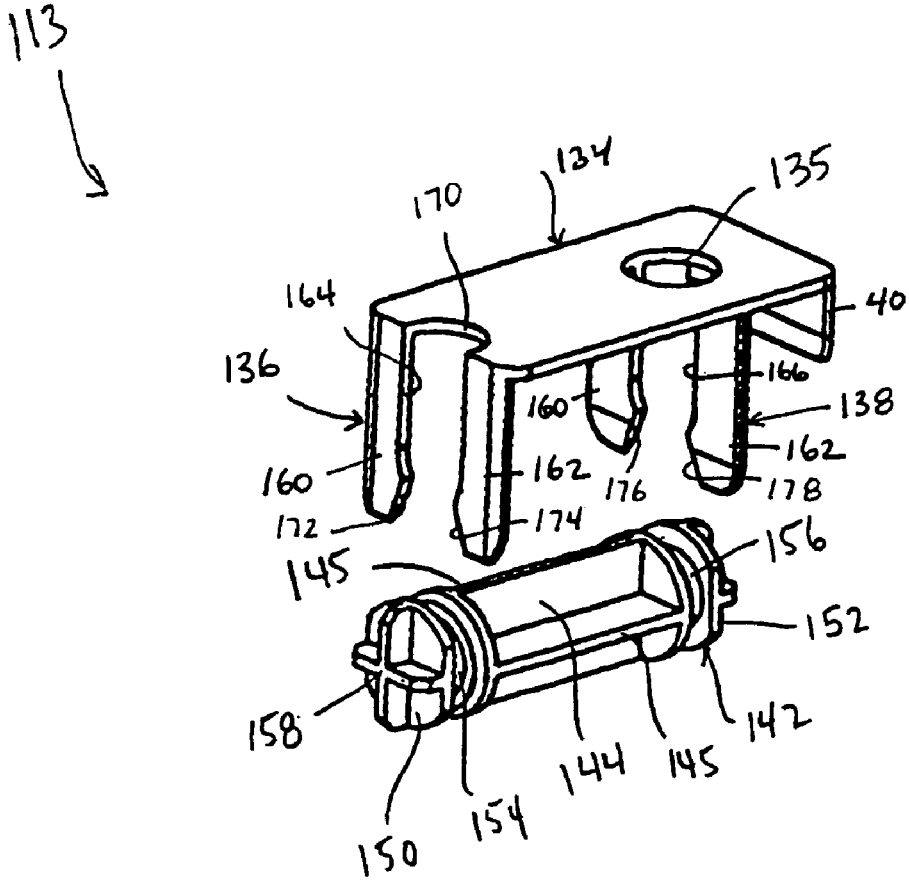
FIG. 5 is an exploded perspective view of another pre-hanging door clip in accordance with the principles of the present invention.

FIG. 5 illustrates pre-hanging door clip 113 according to another embodiment. In the following description of FIG. 5, only the points of difference of the illustrated embodiment from the embodiment illustrated in FIGS. 1 and 3–4 will be described. The clip 113 operates in a substantially similar manner as the clip 13, but realizes a different construction.

The clip 113 includes a slightly different movement limiting structure 142 than movement limiting structure 42 of clip 13. For example, the movement limiting structure 142 includes a mid-portion 144 having a plurality of protrusions 145 extending radially outwardly to form a substantially cross shaped cross section. The substantially cross shaped cross section of the mid-portion 144 has less material and is of a smaller size than the annular cross section of the mid-portion 44 of clip 34. The smaller cross section of the mid-portion 144 helps the clip 113 to realize a cost effective construction.

The movement limiting structure 142 has respective enlarged end sections 150, 152 that straddle the mid-portion 144 at opposite ends thereof. Reduced diameter portions 154, 156 are formed between the mid-portion 144 and each end section 150, 152. Each end section 150, 152 has a cross shaped protrusion 158 extending therefrom. The protrusion 158 replaces the enlarged end sections 50, 52 of the mid-portion 44 described above, which reduces the material needed to construct the movement limiting structure 142. The clip 113 further realizes a cost effective construction.

The clip 113 also includes a slightly different clip 134 than the clip 34 in that a first end wall portion 136 thereof and an intermediate wall portion 138 thereof are formed of a pair of elongated sections 160, 162, respectively. Each pair of elongated sections 160, 162 is spaced from one another by a fixed distance to form respective recesses 164, 166. The width of the recesses 164, 166 substantially corresponds to the width of the reduced diameter portions 154, 156 formed between the mid-portion 144 and each end section 150, 152. Each pair of elongated sections 160, 162 are configured to receive either reduced diameter portion 154, 156 of the movement limiting structure 142 such that upon the application of manual force, either reduced diameter portion 154, 156 can be positioned into the respective recess 164, 166. The elongated sections 160, 162 each include outwardly diverging surfaces 172, 174 and 176, 178, respectively, at lower ends thereof.

The clip 134 differs from the clip 34 of clip 13 in that the clip 134 includes a locating opening 135 formed therein. The locating opening 135 is positioned substantially above the intermediate wall portion 138 and allows a user to align or locate the reduced diameter portions 154, 156 with the recess 166 formed in the intermediate wall portion 138. Similarly, the clip 34 can include a locating recess 170 extending from the recess 164 formed in the first end wall portion 136. The locating recess 170 is positioned substantially above the first end wall portion 136 and allows a user to align or locate the reduced diameter portions 154, 156 with the recess 164 formed in the first end wall portion 136. Although not shown, the locator opening 135 or a locating recess 170 could be incorporated in the clip 34 of clip 13 described above as well.

Installation of clips 13 and 113 are effected in the same manner when the door 12 is moved into a closed position with respect to the door frame 14. In the closed position, the door edge 28 substantially aligns with the strike jamb 20. A movement limiting structure 42 or 142 can be positioned within the hardware opening 30 and the axial bore 32 of the door 12 so that one end section 50, 150 or 52, 152 engages the recess 31 of the strike jamb 20. The mid-portion 44 or 144 and the other end section will extend through the hardware opening 30 and the axial bore 32. The reduced diameter portions 54, 154, 56, 156 are moved to abut the outwardly diverging surfaces 66, 68 and 70, 72 of the movement limiting structure 42 or the outwardly diverging surfaces 172, 174 and 176, 178 of the movement limiting structure 142. Application of manual force to the clip 34, 134 can move the reduced diameter portion 54, 56 into the respective recess 60, 62 of clip 34 or the respective recess 164, 166 of clip 134. The outwardly diverging surfaces 66, 68 and 70, 72 of the movement limiting structure 42 or the outwardly diverging surfaces 172, 174 and 176, 178 of the movement limiting structure 142 retain the reduced diameter portion 54, 56 in the respective recess 60, 62 or 164, 166. In this manner, the movement limiting structures 42, 142 can be fixedly secured to the clips 34, 134.

It will be appreciated that numerous modifications to and departures from the preferred embodiments described above will occur to those having skill in the art. Thus, it is intended that the present invention covers the modifications and variations of the invention, provided they come within the scope of the appended claims and their equivalents.

What is claimed is:

1. A pre-hanging door clip for a pre-hung door assembly, comprising:

an elongate member having first and second opposite ends, a mid portion intermediate said first and second ends and having a first diameter, and a first engagement section intermediate said first and second ends, said first engagement section having a second diameter less than said first diameter;

a clip having a substantially planar base having first and second opposite ends, a first wall extending outwardly from said first end of said base and substantially perpendicular to said planar base, and a second wall extending outwardly from said second end of said base and substantially perpendicular to said planar base, and a third wall intermediate said first and second walls and extending outwardly from and substantially perpendicular to said planar base, said third wall including a recess adjacent a free end thereof, said recess defining resiliently deflectable arms of said third wall, said arms including outwardly diverging surfaces extending from said recess to said free end, said surfaces forming an opening to said recess, said first engagement section releaseably securable in said recess.

2. The pre-hanging door clip of claim 1, wherein said elongate member includes a second engagement section spaced from said first engagement section and proximate said second end of said elongate member.

3. The pre-hanging door clip of claim 2, wherein said second wall includes a recess adjacent a distal end thereof, said second wall recess defining resiliently deflectable arms of said second wall, said second wall arms including outwardly diverging surfaces extending from said second wall recess to said distal end said second wall surfaces forming an opening in said second wall, said second engagement section releaseably securable in said recess of said second wall.

4. A pre-hung entry door assembly for building structures, comprising:

a door frame having a strike jamb, said strike jamb having a recess intermediate opposite ends thereof;

a door having a strike edge spaced from said strike jamb and defining therebetween a gap, a face bore proximate said strike edge, and an strike edge bore extending from said strike edge to said face bore, said strike edge bore axially aligned with said recess;

an elongate member having first and second opposite ends disposed within said said axially aligned recess and strike edge bore, said elongate member having a first engagement section intermediate said first and second ends, said first engagement section disposed within said gap; and a clip having a substantially planar base having at least first and second spaced walls extending outwardly from and substantially perpendicular to said planar base, said first wall including a recess adjacent a distal end thereof said recess defining resiliently deflectable arms of said first wall, said arms including outwardly diverging surfaces extending from said recess to said distal end said surfaces forming an opening in said distal end, said first engagement section releaseably secured in said recess, and said second wall extending into said face bore, said first and second walls maintaining said elongate member within said said axially aligned recess and strike edge bore, thereby limiting movement of said door relative to said door frame.

5. The pre-hung entry door assembly of claim 4, wherein said clip includes a third wall extending outwardly from and substantially perpendicular to said planar base, said third wall abutting an outer surface of said strike jamb.

6. The pre-hung entry door assembly of claim 4, wherein said elongate member is cylindrical.

7. The pre-hung entry door assembly of claim 6, wherein said cylindrical elongate member includes a central portion having a first diameter, said engagement section having a second diameter less than said first diameter.

8. The pre-hung entry door assembly of claim 7, wherein said cylindrical elongate member includes a second engagement section spaced from said first engagement section and proximate said second end thereof.

9. The pre-hung entry door assembly of claim 8, wherein said second wall includes a recess adjacent a distal end thereof, said second wall recess defining resiliently deflectable arms of said second wall, said second wall arms including outwardly diverging surfaces extending from said second wall recess to said second wall distal end, said second wall surfaces forming an opening in said second wall distal end, said second engagement section releaseably secured in said recess of said second wall.

* * * * *